United States Patent [19]

Yokoyama

[11] Patent Number: 4,603,453

[45] Date of Patent: Aug. 5, 1986

[54] DEVICE FOR ATTACHING A DETECTABLE SHOPLIFTING PREVENTION BODY

[75] Inventor: Ryuzo Yokoyama, Hiroshima, Japan

[73] Assignee: Kabushiki Kaisha Yokoyama Seimitsu Kousakusho, Hiroshima, Japan

[21] Appl. No.: 707,805

[22] Filed: Mar. 4, 1985

[30] Foreign Application Priority Data

Mar. 3, 1984 [JP] Japan ..... 59-30113[U]

[51] Int. Cl.[4] ..... A44B 9/00; G08B 21/00

[52] U.S. Cl. ..... 24/155 R; 24/150 R; 24/155 RB; 335/295

[58] Field of Search ..... 24/155 R, 155 RB, 155 BR, 24/155 C, 155 CC, 155 SD, 150 R, 110, 108; 292/252; 335/295; 70/282

[56] References Cited

U.S. PATENT DOCUMENTS

| | | | |
|---|---|---|---|
| 931,023 | 8/1909 | Albertoni et al. | 24/150 R |
| 1,020,784 | 3/1912 | Vallier | 24/155 R |
| 1,065,764 | 6/1913 | Anthony | 24/155 R |
| 1,088,967 | 3/1914 | Chritton | 24/155 R |
| 1,089,949 | 3/1914 | Nutter | 24/155 RB |
| 1,153,615 | 9/1915 | Forsheim et al. | 24/155 R |
| 1,192,612 | 7/1916 | Fischer | 24/155 R |
| 1,193,111 | 8/1916 | Breidenbach | 24/155 RB |
| 2,643,429 | 6/1953 | Wittstock | 24/155 R |
| 4,104,622 | 8/1978 | Van Niel | 24/110 |
| 4,339,853 | 7/1982 | Lipschitz | 292/252 |

*Primary Examiner*—Victor N. Sakran

*Attorney, Agent, or Firm*—Oblon, Fisher, Spivak, McClelland & Maier

[57] ABSTRACT

A plastic hollow body contains a resilient spring plate. The spring plate is attached to the body at one end and, at another end, has an iron core. A hole in the body is slightly offset from a hole in the spring plate such that a pin extending through the hole in the body cannot pass through the hole in the spring plate until the spring plate is bent by a force from the spring. The pin then extends through the hole in the spring plate and the spring plate is locked onto a reduced diameter portion of the pin. The release of the pin is possible only by applying a magnet adjacent the iron core so as to move the spring plate from the locked position.

5 Claims, 4 Drawing Figures

DEVICE FOR ATTACHING A DETECTABLE SHOPLIFTING PREVENTION BODY

BACKGROUND OF THE INVENTION

The present invention relates to a device for attaching a detectable shoplifting prevention body to a commodity.

Shoplifting prevention equipment is made to have a detectable body kept attached to the commodity. When a customer buys the commodity, the detectable body is removed from the commodity at the sales counter. If someone tries to unlawfully remove the commodity from the store, the detectable body will be detected by a detector installed at the store entrance, and the store personnel will be alerted, as by sounding an alarm.

Therefore it is necessary to attach detectable body to all commodities. In the past a nylon fixture has been used as the means of attaching. However, this method has the weak point that nylon is easily cut by scissors.

SUMMARY OF THE INVENTION

The present invention has as its object a device to attach the detectable shoplifting prevention body such that it can be attached simply, cannot be removed unlawfully but can easily be removed in a proper way.

BRIEF DESCRIPTION OF THE DRAWING

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

In a first embodiment, the invention consists of metallic pin 2 which attaches a commodity and the detectable body 1, and locking device 3 which prevents removal of pin 2.

Figure 3:
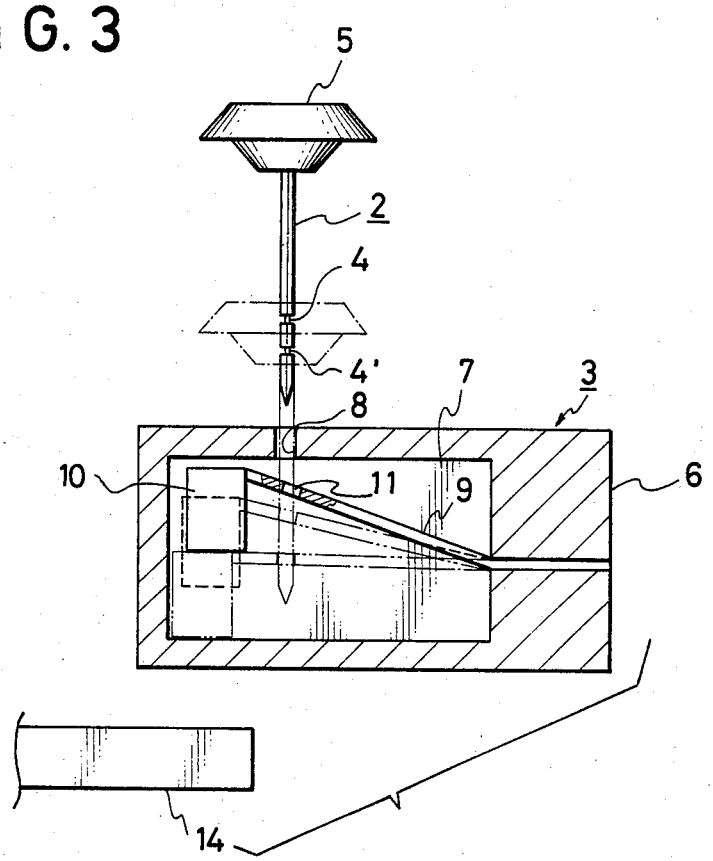
FIG. 3 is a sectional view of the first embodiment.
Figure 4:
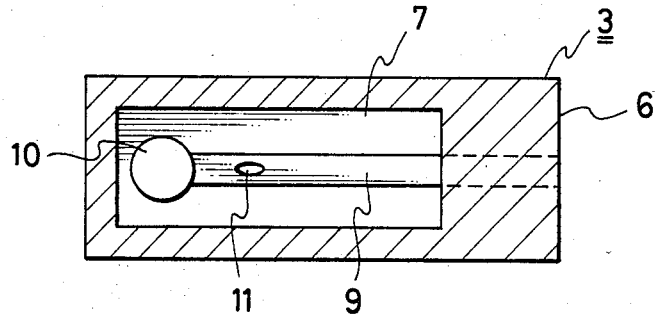
FIG. 4 indicates the sectional plane view of the first embodiment.

Pin 2 is formed with a shaft having a plural number of circumferential engaging grooves 4, 4', and a grip 5 at one end as shown in FIG. 3.

The locking device 3 is formed with a hollow operation chamber 7 in the interior of rectangular parallelepiped main body 6 which is made of a non-magnetic material such as plastic. A pin inserting hole 8 in the main body 6 has a shape and size corresponding to that of the pin shaft for a close fit therebetween and extends to the operation chamber 7. A pin engaging plate 9 is positioned in the operation chamber 7. The pin engaging plate 9 is formed from a resilient spring plate. An end thereof is fixed to the body 6 at about the center of the main body 6, and the other end is provided with an iron core 10 fixed thereto. The spring plate 9 is bent so that the end having the iron core 10 extends towards the inserting hole 8 at an oblique angle so that the spring plate is always biased to the side of the pin inserting hole 8. Further, the pin engaging plate 9 has drilled therethrough an elongated engaging hole 11. This engaging hole 11 is formed so that the end of the hole 11 closest to the iron core 10 is located between the center line of the hole 8 and the iron core 10 and sufficiently near to the center line of the pin inserting hole 8 so that only the end point of the pin 2 can be inserted into the hole 11 when the pin engaging plate 9 is in the waiting position as shown by the solid line in FIG. 3.

Figure 1:
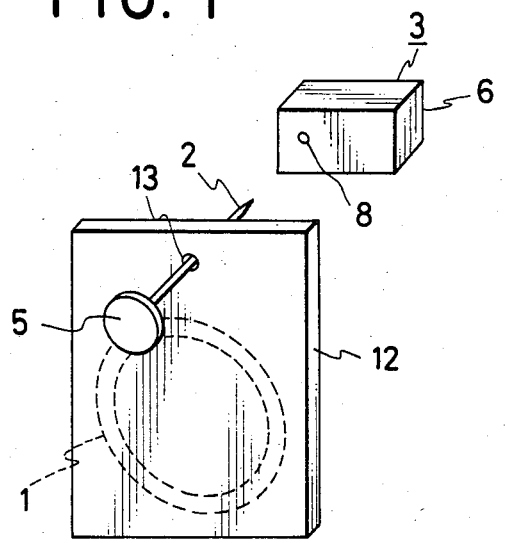
FIG. 1 is an exploded perspective view of first embodiment.
Figure 2:
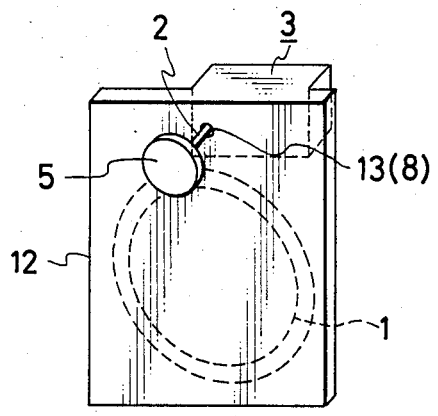
FIG. 2 is a perspective view of a second embodiment.

Further, the tag 12 incorporating the detectable body 1 has a pin hole 13 and can be constructed as a separate body from the locking device 3, as shown in FIG. 1. Alternatively, the detecting body 1 can be made as one body with the locking device 3 as in the second embodiment shown in FIG. 2.

In either embodiment, the pin 2 is first put through the commodity such as clothing, and then inserted in pin hole 13. In the first embodiment, after being put through the pin hole 13 of the tag 12, the pin 2 is also inserted through the pin inserting hole 8. Other operations are the same in both embodiments, and only the relation of pin 2 and locking device 3 will be explained in the following. When the pin 2 is inserted into the pin inserting hole 8, only the end of the pin 2 is inserted into the engaging hole 11 of the pin engaging plate 9. However, the large diameter portion of the pin 2 cannot be inserted into the engaging hole 11, because the iron core 10 side end of the engaging hole 11 is located approximately in alignment with the center line of the pin inserting hole 8, and so the pin engaging plate 9 is pushed downwards with and by the descent of the pin 2. With this downwards movement, the end position of the engaging hole 11 is shifted down and to the left as seen in FIG. 3. With this shift of the hole 11 relative to the pin hole center, the large diameter part of the pin 2 can be inserted into the engaging hole 11. When the large diameter part of the pin 2 is thus inserted into the engaging hole 11, the downward force applied to the engaging plate by the pin is diminished, and the pin engaging plate 9 will tend to resume the original position due to its elasticity, as shown by the solid line in FIG. 3. This restoration will make the iron core 10 side of the pin engaging plate 9 rise and the engaging hole 11 of the pin engaging plate 9 can fit into the engaging groove 4 or 4' of the pin (see FIG. 3, dashed line) In this situation, the attachment of tag 12 is completed.

When a shoplifter tries to remove a commodity unlawfully, detection equipment, installed at the store entrance but not shown in the drawing, detects the detectable body 1, and store personnel are alerted by indication means such as an alarm.

Further, when the pin 2 is pulled outward with the intention to remove the tag 12 from the commodity, the pin engaging plate 9 is engaged with the engagement groove 4' of the pin 2, and the pin engaging plate 9 tends to go up (as seen in FIG. 3) when the pin 2 is being pulled. With the upward movement of the pin engaging plate 9, the edge of the engaging hole 11 engaging the engagement groove 4' moves to the right in FIG. 3. As a result, the engagement of engaging groove 4' and engaging hole 11 will become more solid, and the pin 2 cannot be pulled out.

When the commodity is purchased, the iron core 10 is pulled down by a powerful magnet 14 at the sales counter, as shown in the FIG. 3, and so the pin engaging plate 9 moves down to the horizontal position as shown by a chain lines. As a result, the iron core 10 side edge of the engaging hole 11 will be moved left to a position spaced from the pin 2, and the engagement with the engagement groove 4' will be released. The pin 2 can thus be pulled up, and the tag 12 removed from the commodity.

The detectable body 1 may an oscillator/radiator or other energy responsive body in accordance with the type of detecting equipment used, and various systems may be used.

Further, the engaging hole 11 has been described as a elongated hole. However the shape is not restricted to this shape, but can be formed to various forms including teardrop form.

Because of the structure and function of this invention as stated in the above embodiments, when pin 2 is once inserted into the main body 6, and the pin engaging plate 9 and the engagement groove 4' of the pin 2 are engaged, the pin cannot be removed by pulling it, and this prevents theft.

Moreover, since the pin 2 is made of metal, it cannot be easily cut.

Further, the pulling out of pin 2 can be simply done by use of a magnet.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for attaching a detectable shoplifting prevention body to a commodity, comprising:

a non-magnetically attractive hollow body;

a first hole in a wall of said hollow body, said first hole having a center line;

a resilient plate positioned in the hollow of said body and having a first end fixed to said body, said plate being normally resiliently positioned such that said plate entends from said first end towards said wall at an oblique angle to said wall;

a magnetically attractive core in said hollow body and fixed to a second end of said plate;

a pin having a grip member and being sized to fit through said first hole, said pin having at least one small diameter portion near an end thereof and groove means along the length thereof;

a second hole in said plate, said second hole being sized to permit passage of said pin when the length of said plate entends substantially perpendicular to an axis of said pin, wherein said resilient plate will flex toward said groove means for locking said pin to said housing, said second hole being positioned such that when said plate is in said normal position, an edge of said pin closest to said core is positioned between said center line of said first hole and said core and sufficiently close to said center line of said first hole that said pin cannot fit into said second hole; and a detectable body having a third hole sized to permit passage of said pin.

2. The device of claim 1 wherein said second hole is elongated in the direction of the length of said plate.

3. The device of claim 1 wherein said detectable body is formed unitary with said hollow body, with said first and third hole alignment.

4. The device of claim 2 wherein said detectable body is formed unitary with said hollow body, with said first and third hole in alignment.

5. The device of claim 1 in combination with a magnet positionable near said hollow body.

* * * * *